United States Patent [19]

Hotta et al.

[11] 4,369,392

[45] Jan. 18, 1983

[54] OXIDE-COATED CATHODE AND METHOD OF PRODUCING THE SAME

[75] Inventors: Sadayoshi Hotta; Masanori Watanabe, both of Osaka, Japan

[73] Assignee: Matsushita Electric Industrial Co., Ltd., Kadoma, Japan

[21] Appl. No.: 187,701

[22] Filed: Sep. 16, 1980

[30] Foreign Application Priority Data

Sep. 20, 1979 [JP] Japan ..... 54/121093
Jan. 17, 1980 [JP] Japan ..... 55/4353

[51] Int. Cl.[3] ..... H01J 1/14
[52] U.S. Cl. ..... 313/346 R; 313/346 DC; 427/77
[58] Field of Search ..... 313/346, 355; 428/375; 250/509; 427/77

[56] References Cited

U.S. PATENT DOCUMENTS 2,722,626 11/1955 Coppola et al. ..... 313/346 DC
3,243,638 3/1966 Affleck ..... 313/346 R
3,351,486 11/1967 Buescher et al. ..... 313/346 R
3,393,090 7/1968 Barraco ..... 427/77

*Primary Examiner*—Harold A. Dixon
*Attorney, Agent, or Firm*—Amster, Rothstein & Engelberg

[57] ABSTRACT

An oxide-coated cathode used for the electron tubes such as cathode ray tubes and camera tubes, comprising as the base a sintered product principally composed of an alkaline earth metal compound and a high-melting-point metal and having high heat conductivity and low specific resistance, said sintered product being either used singly or layered on a high-melting-point metal body containing a reducible element or elements as impurity, and an oxide cathode material coated on said base, and a method of producing such oxide-coated cathode.

5 Claims, 10 Drawing Figures

OXIDE-COATED CATHODE AND METHOD OF PRODUCING THE SAME

FIELD OF THE INVENTION

This invention relates to an oxide-coated cathode comprising a base made of a high-melting-point metal such as Ni and coated with an oxide of an alkaline earth metal such as Ba, Sr, Ca, etc., and a method of producing such oxide-coated cathode. More particularly, the invention relates to an oxide-coated cathode of said type which is capable of producing an emission current of a high density on the order of 1–2 A/cm$^2$ at a relatively low working temperature for a prolonged period of time continuously, excellent in keeping quality after manufacture, suited for mass production, better in thermal efficiency than the conventional oxide-coated cathodes and short in the emission rise-up time after switch-on of the heater, and a method of producing such cathode.

BRIEF DESCRIPTION OF THE DRAWING

Referring to the accompanying drawings.

DESCRIPTION OF THE PRIOR ART

Figure 1:
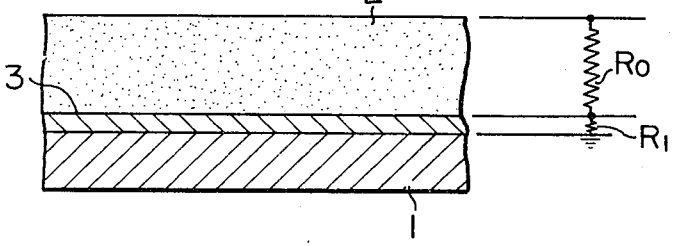
FIG. 1 is a sectional view of a principal part of a conventional oxide-coated cathode.

Oxide-coated cathodes have been used in the electron tubes such as cathode ray tubes and camera tubes. Referring to FIG. 1, there is shown a sectional view of a principal part of a conventional oxide-coated cathode (equivalent circuit arrangement being shown on the right side). In the drawing, reference numeral 1 indicates a directly heated type base which generates heat upon supply of a current or an indirectly heated type base which is heated by a heater provided nearby, and 2 shows a thermion-emitting alkaline earth metal oxide (hereinafter referred to simply as oxide) which is coated on said base 1. The base 1 is a high-melting-point metal such as Ni usually containing a reducible element(s) such as Mg, Si, W, etc., as impurity, and during operation of the cathode with its base 1 heated, the reducible element such as Mg, Si, W, etc., diffused toward the oxide film 2 is reacted with said oxide film 2 to produce free Ba to maintain the electron emitting performance of the oxide cathode. This reaction causes growth of a high-resistance layer which is called intermediate layer, indicated by numeral 3, at the interface between the base 1 and the oxide film 2. The specific resistance of the oxide film 2 in an oxide-coated cathode is variable depending on the concentration of free Ba, but it is usually as high as $10^2$–$10^3\Omega\cdot$cm even in an optimum condition, and the specific resistance of said intermediate layer 3 can reach $10^6\Omega\cdot$cm in the case of $Ba_2SiO_4$ or the like. Therefore, the emitted current must pass through resistance $R_1$ of the intermediate layer 3 and resistance $R_0$ of the oxide film 2 from the base 1, and as a result, the electron emitting part of the cathode generates heat of an amount defined by:

$$Ph-v=Ie^2(R_1+R_0)\text{W/cm}^2 \ldots \quad (1)$$

wherein Ie is the emitted current density (A/cm$^2$), and $R_0$ and $R_1$ are resistance of the oxide film 2 and resistance ($\Omega$/cm$^2$) of the intermediate layer 3, respectively, of the actual cathode as calculated per unit area. In the case of an indirectly heated cathode, assuming that the power fed to the heater provided adjacent to the base 1 is $P_H$ and the whole surface area of the cathode is S, then $P_H/S$ is called characteristic heater power. In the conventional indirectly heated oxide cathodes, said characteristic heater power $P_H/S$ is on the order of 2–3 (W/cm$^2$). When said heat generation rises to an amount unnegligible in comparison with said value of characteristic heater power, the electron emitting parts 1 and 2 of the cathode are self-heated to elevate the temperature, resulting in a reduced life of the cathode or, in the worst case, breakdown of the cathode. Thus, in the conventional oxide-coated cathodes in which the thickness of the oxide film 2 is around 6–100 $\mu$m, the density of the emission current obtainable was subjected to a certain limit, or 0.5–1 A/cm$^2$ at highest. Also, in order to constantly obtain an emission current of high density close to the limit level, it is required to slightly elevate the operating temperature of the cathode, but this leads to an increased amount of evaporation of Ba and BaO, an increased consumption rate of the reducing agent such as Mg, Si, W, etc., and an increased growing rate of the intermediate layer 3, resulting in a shortened life of the cathode. If it is attempted to simply enlarge the thickness of the oxide film 2 for increasing the initial BaO content by an amount corresponding to the evaporation loss of Ba and BaO to thereby overcome said problem, there results an increase of cathode resistance $R_0$ in FIG. 1, making it impossible to produce a high-density emission current. Also, heat conductivity of the oxide film 2 is on the order of $5\times10^{-4}$ to $5\times10^{-3}$ (W/°K.·cm) and the surface temperature of the oxide film 2 is lower by about 20° K. than the cathode base temperature even in case the oxide film is of an ordinary thickness, or about 100 μm, and this temperature difference is proportional to the film thickness, so that if the thickness of the oxide film 2 is increased, it is necessitated to correspondingly elevate the cathode base temperature as well as the surface temperature of the oxide film 2 for maintaining the emission current constant. This would promote consumption of the reducing agent, resulting in a shortened life or an increased power consumption of the heater. It has been also conceived to increase the thickness of the base 1 to compensate for the consumption of the reducing agent, but since growth of the intermediate layer 3 is due to the reaction between BaO and reducing agent, it was impossible with this means to attain the object of providing a high-density emission current if the intermediate layer 3 is enlarged in thickness.

There are also known the cathodes such as so-called matrix cathode and impregnated cathode which are capable of constantly emitting a current of around 1–2 A/cm$^2$ unlike the ordinary oxide-coated cathodes. However, these cathodes are extremely high in working temperature, which is 950°–1,150° C., as compared with the working temperature (770°–830° C.) of the oxide-coated cathodes, and also the power consumption of the heater is more than double to thrice as much as that in the oxide-coated cathodes. In comparison with these cathodes, said molded cathode and oxide-coated cathode using as base a pressure-molded mixture of a high-melting-point metal powder, an alkaline earth metal compound powder, a reducing agent powder, etc., according to this invention are the cathodes of the type which is capable of electron emission of a high current density. In the case of these oxide-coated cathodes, however, the electron emitting capacity of the cathodes and keeping quality thereof after manufacture are greatly affected by the selection of the ratio of the high-melting-point metal in the mixed powder used for the production of such oxide-coated cathodes. Improper selection of said ratio may make it necessary to elevate the cathode temperature for obtaining a desired emission current or may shorten the life of the cathode. Also, these cathodes are usually left exposed to the air for a long time till they are put to use, and their keeping quality in the air would be poor if the Ni ratio in the composition is improper, so that these cathodes might prove unsuited for mass production. On the other hand, as the high-current-density cathodes, there have been deviced various types of cathodes such as impregnated cathode mentioned above, and as regards their working temperature, the ordinary type of oxide-coated cathodes are lowest in such working temperature, followed by the molded cathodes, and other types of high-current-density cathodes necessitate a high power consumption. Further, impregnated cathode involves many difficulties in its production as it necessitates a high temperature (1,800°–2,000° C.) pre-treatment and a cutting step.

SUMMARY OF THE INVENTION

The present invention has been deviced with the object of eliminating these problems of the prior art, and it is intended to provide an oxide-coated cathode which is capable of continuous and stable emission of a high-density (1–2 A/cm$^2$) current for a long time at a relatively low working temperature, or around 800°–850° C., substantially same level as required for the conventional oxide-coated cathodes, and which is excellent in thermal efficiency and also shorter than the ordinary oxide-coated cathodes in emission rise-up time after switch-on of heater, to provide a method of producing such cathode. This invention also concerns a cathode base composed of a sintered product having best adaptability to the oxide-coated cathodes.

Thus, an object of this invention is to provide an oxide-coated cathode characterized in that a sintered product (sintered cathode) principally composed of an alkaline earth metal compound and a high-melting-point metal and having high heat conductivity and low specific resistance is used as base, or a structure formed by providing said sintered product on a high-melting-point metal containing a reducible element as impurity is used as base, and such base is coated with an oxide cathode material.

Another object of this invention is to provide a method of producing an oxide-coated cathode which comprises uniformly mixing powder of an alkaline earth metal compound, powder of a high-melting-point metal and powder of at least one of the reducible elements such as Zr, Al, Si, Mg, Co, Ti, etc., either in the single form or in the form of compounds, then pressure molding said powder mixture singly or together with a high-melting-point metal such as Ni, sintering the molding to form a cathode base, and then providing an oxide cathode material on said base.

The thermionic cathode according to this invention is a type of oxide cathode featuring a base formed by pressure molding a powder mixture either singly or together with a high-melting-point metal such as Ni, said powder mixture consisting of 71–81% by weight of powder of a high-melting-point metal, powder of at least one of the reducible elements such as Al, Si, Mg, Co, Ti, Zr, etc., either in the single form or in the form of compounds, and powder of an alkaline earth metal compound.

The oxide cathode according to this invention is also characterized in that the molar ratio of the alkaline earth metals Ba, Sr and Ca in the alkaline earth metal compound used for said sintered product {Ba/(Ba+Sr+Ca)} is 0.75±0.1.

DESCRIPTION OF THE PREFERRED EMBODIMENTS

The device of the present invention is now described in detail in comparison with the hitherto used ordinary oxide-coated cathodes while referring to the accompanying drawings.

Figure 2:
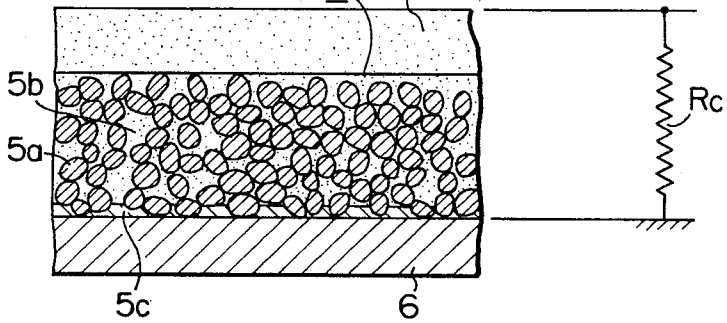
FIG. 2 is a sectional view of a principal part of an oxide-coated cathode according to an embodiment of this invention.
Figure 3:
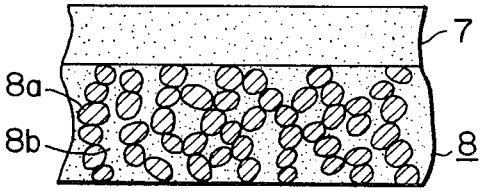
FIG. 3 is a sectional view of a principal part of an oxide-coated cathode according to another embodiment of this invention.

FIGS. 2 and 3 are the sectional views of the principal parts of the oxide cathodes according to this invention. In these figures, numerals 5 and 8 designate a member principally composed of an alkaline earth metal compound a high-melting-point metal and having high heat conductivity and small specific resistance. An example of said alkaline earth metal compound is (Ba, Sr, Ca)$CO_3$, and an example of said high-melting-point metal is Ni. In the member 5 of FIG. 2, 5*a* indicates the areas taken by a high-melting-point metal such as Ni and 5*b* indicates the area taken by an alkaline earth metal compound such as (Ba, Sr, Ca)$CO_3$. Likewise, 8*a* and 8*b* in FIG. 3 indicate the areas taken by a high-melting-point metal and an alkaline earth metal, respectively. In FIG. 2, numeral 6 refers to a high-melting-point metal base on which said member 5 is arranged in an electrically and thermally well contacted state. In the structure of FIG. 2, said high-melting-point metal 6 and member 5 constitute a cathode base, and in the structure of FIG. 3, said member 8 alone constitutes the base, and an ordinary oxide cathode material 4 or 7 is formed on said base 5 and 6 or 8. The high-melting-point metal layer 6 in FIG. 2 preferably contains a reducible element as impurity for the reasons of weight gain of the reducing agent and free Ba forming rate. A reducible element or elements, either in the single form or in the form of a compound, is contained in an amount of 0 to several % in the member 5 or 8, too. In the ordinary oxide-coated cathodes, as mentioned before, formation of the free Ba essential for the operation of the oxide cathode is accomplished, in the case of FIG. 1, as the reducible element contained in the base metal 1 is diffused toward the oxide film 2 and reacted with the oxide, allowing growth of a high-resistance layer called intermediate layer 3 at the interface between the base 1 and the oxide film 2. FIG. 1 shows an equivalent circuit on the right side together with a sectional view of a principal part of the oxide cathode. The internal resistance ($R_1+R_0$) of the oxide cathode increases with time. Growth of this intermediate layer 3 obstructs emission of a high-density current, but in the embodiments of this invention as illustrated in FIGS. 2 and 3, the member 5 or 8 principally composed of an alkaline earth metal compound and a high-melting-point metal, or a reducible element contained in the high-melting-point metal layer 6 is reacted with an alkaline earth metal compound in said member 5 or 8 or at the interface between said member 5 and metal layer 6 to form free Ba and the latter is diffused into the oxide film 4 or 7 to maintain the cathode operation in the embodiments of this invention. In this case, the reaction product forms an intermediate layer 5c such as mentioned above at the interface between the members 5 and 6, but unlike the device of FIG. 1, the emission current feed passage does not run through the intermediate layer 5c but goes through the areas of the high-melting-point metal 5a which is a conductor. In other words, the emission current flows through the metal layer 6, high-melting-point metal 5a and coating oxide 4 in that order, so that the cathode resistance Rc shown by way of an equivalent circuit on the right side of FIG. 2 is sufficiently small and does not change with time. Thus, the device of this invention is capable of effecting stable electron emission of a high current density on the order of 1–2 A/cm$^2$ for a long time. For attaining such high-current density electron emission, the specific resistance of the oxide film 4 or 7 is also a matter of much concern like the intermediate layer.

Table 1 shows the resistance $R_0$ of the sufficiently activated oxide film as measured by D. A. Wright [Proc. Roy. Soc., London, (A) 190 (1947), page 394].

TABLE 1

| Temperature dependency of resistance of oxide film | |
|---|---|
| $T_C$ (°K.) | $R_O$ (Ω/cm$^2$) |
| 750 | 27 |
| 830 | 11 |
| 900 | 6 |
| 950 | 4 |
| 1000 | 3 |
| 1050 | 2.2 |

TABLE 1-continued

| Temperature dependency of resistance of oxide film | |
|---|---|
| $T_C$ (°K.) | $R_O$ (Ω/cm$^2$) |
| 1090 | 1.6 |

In the above table, $R_0$ is resistance when the oxide film thickness is 70 μm, with the oxide film area being reduced to the unit area base, and $T_C$ is cathode temperature. The equilibrium between supply and consumption of power at the electron emitting parts is expressed by the following formula (2):

$$P_H+P_{h-v}=P_{rad}+P_{cond}+P_{cooling}\ldots \quad (2)$$

$P_H$ is heater power, $P_{rad}$ is loss of power by heat radiation, $P_{cond}$ is loss of power by heat conduction, $P_{h-v}$ is a nominal relating to the heating effect given by internal resistance of the cathode and $P_{cooling}$ is a nominal relating to the cooling effect involving entrainment of energy by the emitted electrons. The values given here are those calculated per unit area.

When no emission current is drawn, both $P_{h-v}$ and $P_{cooling}$ are 0 and a steady state is reached at such a temperature of each cathode part that the heater input power $P_H$ and the sum of the loss of power by heat radiation and the loss of power by heat conduction ($P_{rad}+P_{cond}$) would become equal to each other. When an emission current Ie is drawn, $P_{h-v}-P_{cooling}$ at the electron emitting part becomes a power which causes rise of temperature at that part beside the heater input power. Therefore, when the emission current density increases and ($P_{h-v}-P_{cooling}$) elevates to such an extent that it is unnegligible in comparison with $P_H$, steadiness of cathode temperature is broken and the temperature of the oxide film at the electron emitting part is raised up by self-heating. This results in an increased evaporation loss of Ba and BaO to shorten the life of the cathode or break it in some cases. The cathode temperature at which the ordinary oxide-coated cathodes are used is 750° C. to 830° C., and the resistance of the sufficiently activated oxide film, as noted from Table 1, is around 2 Ω/cm$^2$ when the film thickness is 70 μm. In this case, the nominal relating to the self-heating $P_{h-v}-P_{cooling}$ takes a value such as shown in Table 2, and when the emission current density exceeds 1 A/cm$^2$, the oxide temperature rises up to shorten the life. Therefore, in case of obtaining an emission current of higher than 1 A/cm$^2$, it is essential that the film resistance is smaller than the value of $R_0'$ such as shown in Table 2 and that the film thickness is less than 60 μm as shown in Table 2, even under the supposition that there takes place no growth of the intermediate layer. If the film thickness exceeds 60 μm, the resistivity of the oxide cathode layer increases to make it unable to attain electron emission of a high current density of over 1 A/cm$^2$, thus spoiling the features of this invention.

TABLE 2

| Self-heating and optimum resistance and thickness of oxide film | | | |
|---|---|---|---|
| Current density (A/cm$^2$) | $P_H$-$P_C$ (W/cm$^2$) | Film resistance $R_O'$ (Ω/cm$^2$) | Film thickness t' (μm) |
| 1 | 0.28 | 1.76 | 60 |
| 1.5 | 1.37 | 1.19 | 40 |
| 2 | 4.21 | 0.92 | 30 |

In the case of the ordinary oxide-coated cathodes, growth of the intermediate layer obstructs flow of a high-density emission current as said before, but is should be also noted that the resistance of the oxide film itself is a detrimental factor for stabilized long-time continuous electron emission of high current density. If the oxide film thickness is reduced for obtaining a high-density emission current in the ordinary oxide-coated cathodes, the initial holding of BaO decreases and as a result the cathode life is reduced due to consumption of BaO. Also, for stably obtaining a high-density emission current, it is necessary to slightly elevate the cathode temperature, and in view of this and the fact that the evaporation rate of Ba and BaO increases, it is very disadvantageous to decrease the oxide film thickness. In the case of the cathodes according to this invention, however, there occurs no growth of an intermediate layer to allow electron emission of high current density, and further even if the oxide film thickness is reduced to a maximum degree that allows electron emission of high current density, both Ba and BaO are supplied to the oxide film for a long time because of the sufficient Ba and BaO supply source in the base of a small specific resistance, so that the cathode shows a stabilized high-density current emission characteristic.

As mentioned before, heat conductivity of the oxide film is as low as $5\times10^{-4}$ to $5\times10^{-3}$ [W/°K.·cm], and the surface temperature of the oxide film with a thickness of 100 μm is lower by about 20° K. than the cathode base temperature when the base temperature is 1,000° K. According to the cathode device of this invention, however, the oxide film thickness can be reduced appreciably owing to the Ba and BaO supply source in the base which has more than 10 to 100 times as high heat conductivity as the oxide film, and if, for instance, the oxide film thickness is reduced to about $\frac{1}{3}$ of that of an ordinary oxide-coated cathode, the difference between surface temperature and base temperature can be lessened to $20\times\frac{1}{3}$. Thus, in case the surface temperature is kept at the same level so as to provide a same emission characteristic, it is possible to lower the cathode base temperature by about 20° K.$\times\frac{2}{3}$, and this allows a corresponding amount of reduction of heater power consumption. It is thus possible to provide the cathode of this invention with better thermal efficiency than the ordinary oxide-coated cathodes. For the same reason, the rising rate of oxide surface temperature by heater feed power is improved, so that it is possible to shorten the emission rise-up time as compared with the ordinary oxide-coated cathodes.

Now, the cathode according to this invention and the method of producing the same are described in detail.

The method of producing an oxide-coated cathode according to this invention comprises uniformly mixing powder of an alkaline earth metal compound, powder of a high-melting-point metal and powder of at least one reducible elements either in the single form or in the form of compounds, pressure molding this powder mixture either singly or together with a high-melting-point metal, sintering the molding to form a cathode base, and then coating this cathode base with an oxide cathode material. According to this method, it is possible to freely blend desired quantities of an alkaline earth metal and a reducible element(s) in the cathode base and also proper surface coarseness provided by powder sintering ensures good adhesion between the oxide coating film and the base. Further, the best characteristics of cathode are well retained.

The following are some embodiments of this invention. For example, a powder mixture is prepared by uniformly mixing about 30% by weight of powder of (Ba, Sr, Ca)$CO_3$ as alkaline earth metal compound, about 70% by weight of powder of Ni as high-melting-point metal and not greater than 2% by weight of powder of a reducing agent such as $ZrH_2$, Al, Mg, etc. This powder mixture is pressure molded along with a high-melting-point metal 6 such as Ni containing a reducible element as impurity to form a molding 5 on the metal 6, or said powder mixture alone is pressure molded to form a molding 8. Such molding is sintered to form a cathode base 5 and 6 or 8 and then this base is coated with an oxide cathode material such as (Ba, Sr, Ca)$CO_3$ by means of spraying, immersion, painting, etc., to thereby produce a cathode according to this invention.

Figure 5:
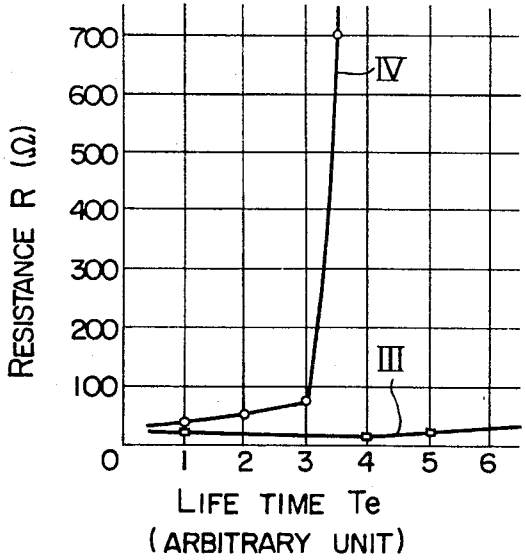
FIG. 5 is a characteristic diagram showing variation of cathode resistance during life time of the cathode according to this invention and that of the conventional oxide-coated cathode.
Figure 4:
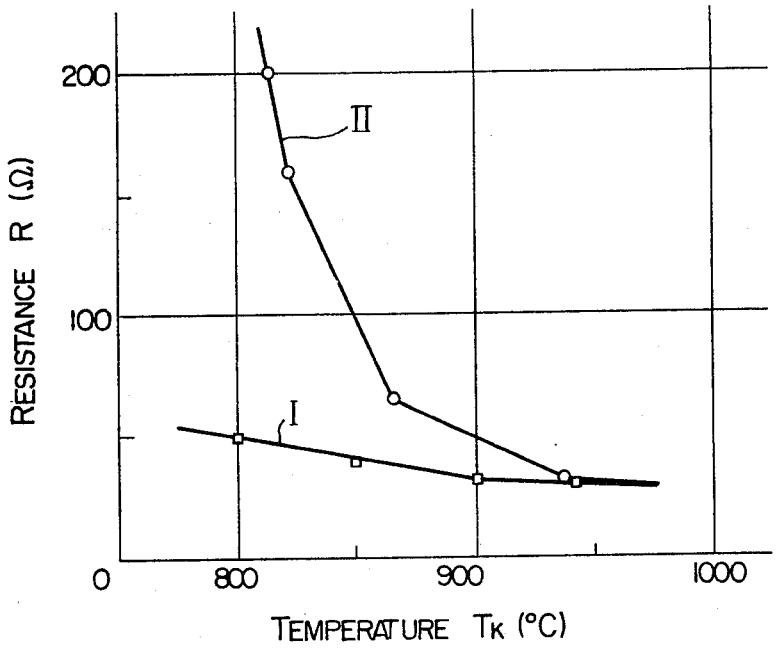
FIG. 4 is a characteristic diagram showing the cathode temperature dependency of cathode resistance of the cathode according to this invention and that of the conventional oxide-coated cathode.
Figure 6:
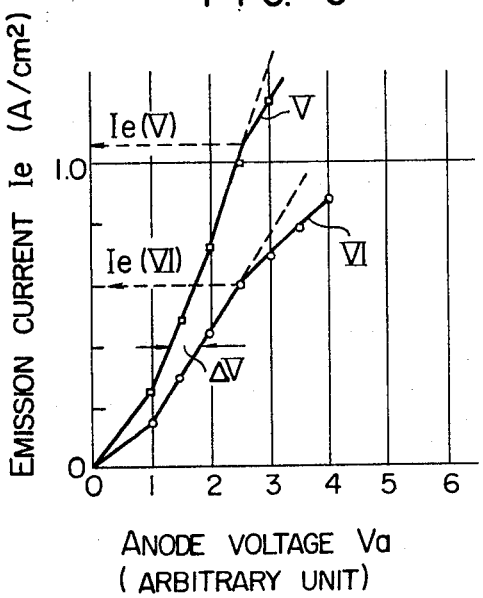
FIG. 6 is a characteristic diagram showing the anode voltage dependency of the emission current of the cathode according to this invention and that of the conventional oxide-coated cathode.

In FIG. 4, I is a graphic representation of cathode resistance of the thus produced actual cathode (diameter: 1.0 mm; base thickness: 500 μm, oxide film thickness: 30 μm) as a function of cathode temperature, and II is a similar graphic representation of cathode resistance of a conventional fully activated oxide-coated cathode (diameter: 1 mm; base thickness: 60 μm, oxide film thickness: 90 μm). As seen from FIG. 4, resistance of the oxide cathode produced according to the method of this invention is almost independent of cathode temperature and lower than that of the ordinary oxide-coated cathode at all cathode temperatures. Particularly, it is noted that the cathode resistance according to this invention is lower by about $\frac{1}{2}$ to 1/10 than that of the conventional cathode in the range of cathode temperatures at which these cathodes are actually used. FIG. 5 is a graphic illustration of variation of cathode resistance during the life time at the cathode temperature of 800° C., wherein III shows such variation of the cathode according to this invention and IV shows said variation of the conventional oxide-coated cathode. As noted from this figure, the cathode resistance of the conventional oxide-coated cathode increases sharply with growth of the intermediate layer whereas the cathode resistance in the device of this invention is very stabilized and undergoes little change with time. FIG. 6 shows anode voltage dependency of emission current at the working temperature of 790° C., wherein V represents the cathode according to this invention and VI represents the conventional oxide-coated cathode. Ie(V) and Ie(VI) show the emission current densities outside the space charge controlled current region. FIG. 6 shows that the cathode according to this invention is superior to the conventional cathode in emission current density at the same cathode temperature. This indicates that the cathode of this invention can provide a high-density emission current at a cathode base temperature equal to or rather lower than that at which the conventional oxide-coated cathode is used. When cathode resistance is small, the relation between emission current Ie and anode voltage Va is defined by the following Langmuir's formula in the space charge controlled region:

$$Ie=\alpha Va^{3/2}\ldots \quad (3)$$

However, when cathode resistance is high and there takes place a potential drop ΔV due to flow of an emission current in the cathode, the emission current does not follow the formula (3) but is given by the following formula:

$$Ie=\alpha(Va-\Delta V)^{3/2}\ldots \quad (4)$$

Figure 7:
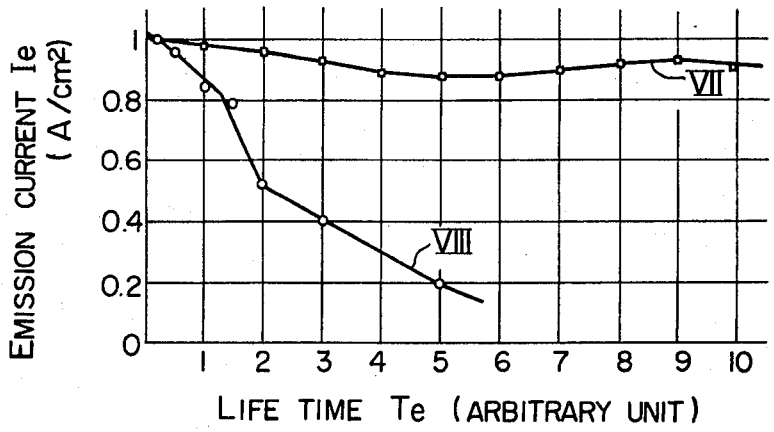
FIG. 7 is a characteristic diagram showing variation of the emission current during life time of the cathode according to this invention and that of the conventional oxide-coated cathode.

In FIG. 6, the cathode of this invention represented by V is conformable to the formula (3) while the conventional oxide-coated cathode represented by VI does not conform to the formula (3) but is consonant to the formula (4). In FIG. 6, ΔV shows the potential drop caused by the emission current. This is another attestation to low resistance of the cathode according to this invention and higher resistance of the conventional oxide-coated cathode. Also, since ΔV is proportional to cathode resistance, it increases with the life time in the ordinary oxide-coated cathodes, and when the cathode is incorporated in an actual electron gun and used under the condition of constant anode voltage, the emission current wanes with the life time, reaching an early end of the life. Particularly, this phenomenon is conspicuous when a high-density emission current is produced since ΔV is also proportional to emission current, and this has been one of the causes of inability of the conventional oxide-coated cathodes in producing a high-density emission current stably for a long time. FIG. 7 is a graph showing variation of emission current during the life time. The emission current is produced continuously at a current density of about 1.5 A/cm$^2$, and in the graph such emission current is plotted by standardizing the initial value as 1. VII represents an oxide cathode according to this invention and VIII represents an ordinary oxide cathode. A same working temperature was used for both cathodes. In the case of the ordinary oxide cathode, the emission current density begins to drop from the early phase, and in only 1.5 life time (arbitrary scale), the emission current density drops to 70%, whereas in the case of the oxide cathode according to this invention, a high-density emission current can be obtained quite stably even after the lapse of more than 7 times as long life time. As is apparent from FIG. 7, the cathode of this invention is capable of producing a high-density electron emission current constantly for a long time at a substantially same cathode temperature as used for the conventional oxide cathodes.

On the other hand, heat conductivity of the base containing an alkaline earth metal compound [(Ba, Sr, Ca)O in the instant embodiment] used in the embodiments of this invention is on the order of 0.1 to 0.05 W/°K.·cm, which is more than 10 to 100 times as high as that of the oxide film which is on the order of $5\times10^{-4}$ to $5\times10^{-3}$ W/°K.·cm, and the temperature difference ΔTs between the heater heated part of the cathode and the base surface is around 1 to 2° K. when the cathode temperature is 1,000° K. In the ordinary oxide cathodes, as mentioned before, the oxide film thickness is about 100 μm and said temperature difference ΔTs' is as large as 20° K. So, when viewed in comparison with this, said temperature difference ΔTs (=1°-2° K.) in this invention is quite small and negligible. Also, in the case of the cathode according to this invention, since Ba and BaO are supplied from the base in principle, the oxide film thickness can be reduced to a significant degree. For instance, if the oxide film thickness is reduced to about 30 μm which is ⅓ of the oxide film thickness in the ordinary oxide cathodes, the difference ΔTs'' between cathode temperature and surface temperature becomes ⅓ of that in the conventional cathodes, and this allows such much lowering of the cathode temperature. Thus, as it is possible to reduce the cathode input power by the heater, the cathode according to this invention is better in thermal efficiency than the conventional ones and, for the same reason, emission rise-up upon power connection to the heater is quick, and hence there can be provided a quick-operating type cathode.

In the above-described embodiment of this invention, there has been used (Ba, Sr, Ca)O obtained by decomposing (Ba, Sr, Ca)$CO_3$ as alkaline earth metal compound, but it is also possible to use an aluminate, tungstate, hydroxide, etc., of an alkaline earth metal. Also, as high-melting-point metal, there may be used not only Ni but also W, Mo, Ta, Pt and the like. Further, the weight ratio of the high-melting-point metal powder to the alkaline earth metal powder need not be confined to 70:30 but may be optionally selected provided that the sintering property would not be spoiled.

On the other hand, for performing electron emission of high current density, it is required that the work function at the electron emitting area is small and that the resistance at the region where the electron emission current flows is also low. In order to lessen the work function, it is essential for the normal operation of the oxide cathodes (the term "oxide cathode" used here refers to all types of cathodes involved including oxide-coated cathodes, molded cathodes, barium-impregnated cathodes, etc.) to liberate Ba in the alkaline earth metal oxide so as to fully cover the electron emitting area with free Ba. In other words, sufficient supply of free Ba is necessary for high-density-current electron emission at a low temperature. For long-time stable supply of free Ba, it needs to increase the Ba content and to properly reduce it with a suitable reducing agent.

The availablility of a high-current-density cathode for its use at low temperature and life potentiality of such cathode depend on whether it is possible to maintain a stable and sufficient free Ba formability for a long time at low temperature. In other words, the life potentiality can be evaluated by measuring the amount of Ba which evaporates from the surface of the working cathode. Regarding the oxide-coated cathodes according to this invention, the evaporation loss of Ba was measured by varying the ratio of the high-melting-point metal powder in the sintered product constituting the base (5 in FIG. 2 and 8 in FIG. 3). It was found as a result that free Ba is produced stably and sufficiently for a long time at the lowest temperature when the ratio of the high-melting-point metal powder is within the range of 71 to 81% by weight. It was also clarified as a result of experiments that the higher the ratio of the high-melting-point metal powder, the higher is the mechanical strength of the pressure molded member 4, but a satisfactory mechanical strength can be obtained when the high-melting-point metal powder is contained in an amount of more than 70% by weight. The fact was also revealed that the best keeping quality of the cathode after its production is obtained when the high-melting-point metal powder content is 71–81% by weight.

From the foregoing results, it may be said that the cathode according to this invention is a hot cathode which is capable of long-time stable electron emission with high current density at a relatively low temperature and which is also excellent in keeping quality after production and suited for mass production. While the invention has been described by exemplifying an indirectly heated type, the invention can as well be applied to the directly heated cathodes in which heat is generated by directly flowing a current to the emitter or base.

EXAMPLE 1

Figure 8:
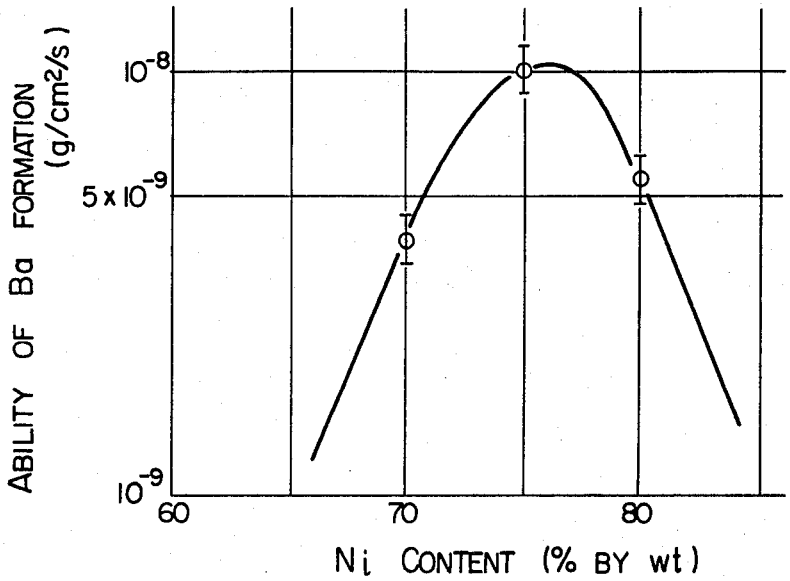
FIG. 8 is a graph showing dependency of the Ba forming ability on the ratio (% by weight) of Ni in the mixed powder composition of the cathode according to this invention.

Ni was used as high-melting-point metal powder and a carbonate of alkaline earth metal was used as alkaline earth metal compound powder, and less than 2% by weight each of Al, Mg and $ZrH_2$ were contained as reducing agent. FIG. 8 shows the result of measurement of Ba forming ability of the fully activated cathode of this example at the cathode temperature of 1,000° C. It was experimentally confirmed that if the Ba forming ability is over $5\times10^{-9}$ (g/cm$^2$/S), electron emission of current density of 1 A/cm$^2$ is possible at a cathode temperature (luminance temperature) of below 750° C.$_b$ and 1.5 A/cm$^2$ at a cathode temperature of below 780° C.$_b$. These values substantially correspond to those calculated with the ordinary oxide-coated cathodes on the supposition that they can withstand high current density.

As seen from FIG. 8, the Ba forming ability is over $5\times10^{-9}$ (g/cm$^2$/S) when the Ni ratio in the composition is 76±5% by weight, and this means that the cathode of this invention can operate at the substantially same cathode temperature at which the ordinary oxide-coated cathodes operate in the best form. Particularly, when the Ni ratio is 76% by weight, the highest Ba forming ability is provided and also the cathode can operate at the lowest temperature.

Figure 9:
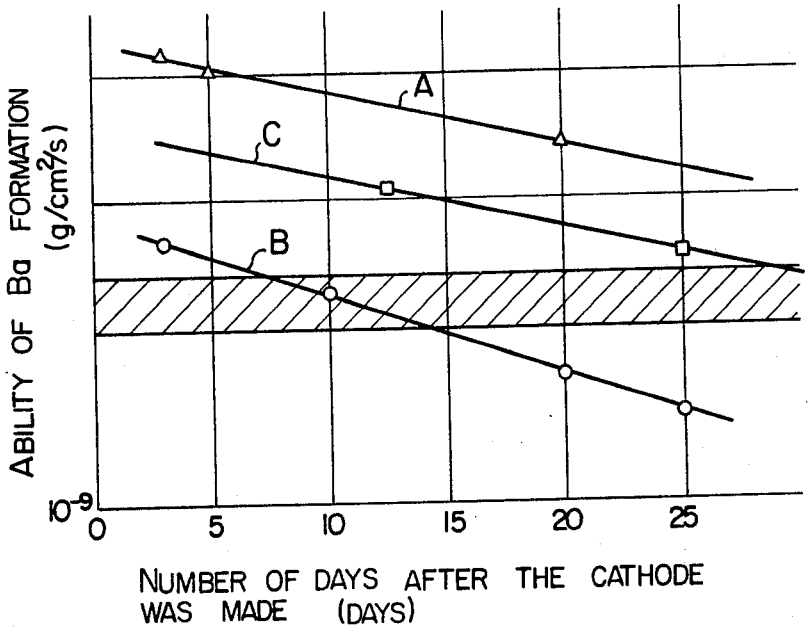
FIG. 9 is a graph showing deterioration of the Ba forming ability with time after production of the cathode according to this invention, with the ratio (% by weight) of Ni in the mixed powder composition being given as parameter, and in the graph the lines A, B and C show the variations when the Ni ratio is 5% by weight, 70% by weight and 80% by weight, respectively.

FIG. 9 shows how the Ba forming ability of the fully activated cathode of this invention varies at 1,000° C. during the period from production to use of the cathode. Lines A, B and C show the variations when the Ni ratio in the composition was 75% by weight, 70% by weight and 80% by weight, respectively. The area indicated by the slant lines shows the Ba forming ability required for achieving electron emission with current density of 1-1.5 A/cm$^2$ at a cathode temperature at which more than 3,000 hours of life can be expected. These results show that the cathodes with the Ni ratio of 70, 80 and 75% by weight, respectively, can well stand use as high-current-density cathodes even if they are kept in storage for the periods of more than one week, one month and two months, respectively, in the air after manufacture. This indicates that the cathodes having good Ba forming ability in a fully activated state are also good in keeping quality. This Ba forming ability is affected by the size and number of a plurality of pores formed by sintering of the high-melting-point metal and heat conductivity of the porous body. Although Ni is used as high-melting-point metal and a carbonate as alkaline earth metal compound in this example, it may well be said with other high-melting-point metals and alkaline earth metal compounds, too, that, generally, the best cathode properties are obtained when the ratio of the high-melting-point metal in the composition is 76±5% by weight.

We have also measured evaporation loss of Ba in the oxide-coated cathodes according to this invention by varying the molar ratio of the alkaline earth metal in the alkaline earth metal compound {Ba/(Ba+Sr+Ca)} in the sintered product (5 in FIG. 2 and 8 in FIG. 3) which constitutes the base of the cathode. It was found as a result that an ample amount of free Ba is produced stably and for a long time at the lowest temperature in case of using an alkaline earth metal compound having said molar ratio of 0.75±0.1. Thus, the cathodes according to this invention are the oxide cathodes which are capable of stable high-current-density electron emission for a long time at a relatively low temperature.

EXAMPLE 2

Figure 10:
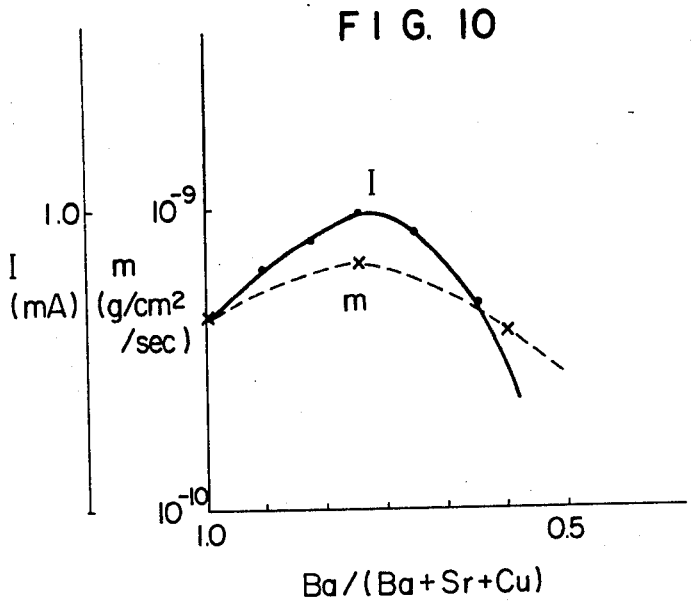
FIG. 10 is a graph illustrating how the Ba forming ability and the emission current obtained in the space charge controlled area depend on the molar ratios of the alkaline earth metals {Ba/(Ba+Ca+Sr)} used in the mixed powder for the cathode according to this invention.

Ni was used as high-melting-point metal powder and a carbonate of alkaline earth metal was used as alkaline earth metal compound powder, and less than 2% by weight each of Al and Zr or $ZrH_2$ were contained as reducing agent. FIG. 10 shows the Ba forming ability m(g/sec/cm$^2$) of the fully activated cathode of this example at the cathode temperature of 900° C. and the maximum emission i(mA) from the 1.2 mm diameter cathode surface in the space-charged area. As seen from FIG. 10, best Ba forming ability and highest emission can be obtained when the molar ratio of the alkaline earth metal Ba/(Ba+Sr+Ca) is 0.75±0.1. Thus, the cathode according to this invention can operate at the lowest temperature ever possible and, as a consequence, it is capable of emitting a high density current constantly for a long time.

As understood from the foregoing description, the oxide cathode according to this invention, as compared with the conventional ones, is capable of producing an emission current of such a high density as 1-2 A/cm$^2$ continuously and stably for a long time at a low temperature substantially same as used with the conventional cathodes of this type. Further, the cathode according to this invention is better in thermal efficiency and shorter in emission rise-up time than the conventional cathodes, and thus there is provided according to this invention a quick-operating type cathode. The production method of this invention is very simple and capable of producing a cathode having said excellent properties. This method is also effective as it is possible to blend any desired amount of an alkaline earth metal compound or a reducing agent in the base. Further, according to the method of this invention, there are provided proper coarseness of the base surface and high adhesion between the oxide film and the base to elevate reliability of the device.

What is claimed is:

1. An oxide-coated cathode comprising as the base a sintered product principally composed of an alkaline earth metal compound and a high-melting-point metal and having high heat conductivity and low specific resistance, said sintered product being used either singly or provided on a high-melting-point metal layer containing a reducible element as impurity, said base being coated with an oxide cathode material.

2. The oxide-coated cathode according to claim 1, wherein the film thickness of said oxide cathode material is less than 60 μm.

3. The oxide-coated cathode according to claim 1 or 2, characterized in that a powder mixture consisting of 71-81% by weight of powder of a high-melting-point metal, powder of at least one of the reducible elements such as Al, Si, Mg, Co, Ti, Zr, etc., either in the single form or in the form of a compound, and an alkaline earth metal compound, is pressure molded either singly or together with a high-melting-point metal such as Ni to thereby form said base.

4. The oxide-coated cathode according to claim 1, 2 or 3, wherein the molar ratio of the alkaline earth metals Ba, Sr and Ca in the alkaline earth metal compound {Ba/(Ba+Sr+Ca)} in said sintered product is 0.75±0.1.

5. A method of producing an oxide-coated cathode which comprises uniformly mixing powder of an alkaline earth metal compound, powder of a high-melting-point metal and powder of at least one of the reducible elements such as Al, Si, Mg, Co, Ti, Zr, etc., either in the single form or in the form of a compound, pressure molding said powder mixture either singly or together with a high-melting-point metal such as Ni to form a cathode base, and then coating said cathode base with an oxide cathode material.

* * * * *